US009040214B2

(12) United States Patent
Fujii et al.

(10) Patent No.: US 9,040,214 B2
(45) Date of Patent: May 26, 2015

(54) ELECTROPHOTOGRAPHIC PHOTOSENSITIVE MEMBER, PROCESS CARTRIDGE AND ELECTROPHOTOGRAPHIC APPARATUS, AND METHOD OF MANUFACTURING ELECTROPHOTOGRAPHIC PHOTOSENSITIVE MEMBER

(75) Inventors: Atsushi Fujii, Yokohama (JP); Hideaki Matsuoka, Mishima (JP); Haruyuki Tsuji, Yokohama (JP); Kazuhisa Shida, Mishima (JP); Nobuhiro Nakamura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/984,264

(22) PCT Filed: Mar. 1, 2012

(86) PCT No.: PCT/JP2012/055888
§ 371 (c)(1),
(2), (4) Date: Aug. 7, 2013

(87) PCT Pub. No.: WO2012/118230
PCT Pub. Date: Sep. 7, 2012

(65) Prior Publication Data

US 2013/0323632 A1 Dec. 5, 2013

(30) Foreign Application Priority Data

Mar. 3, 2011 (JP) ..... 2011-046516
Sep. 29, 2011 (JP) ..... 2011-215134
Feb. 24, 2012 (JP) ..... 2012-039023

(51) Int. Cl.
*G03G 5/00* (2006.01)
*G03G 5/087* (2006.01)

(Continued)

(52) U.S. Cl.
CPC ..... *G03G 5/087* (2013.01); *G03G 5/0507* (2013.01); *G03G 5/104* (2013.01); *G03G 5/0525* (2013.01); *G03G 21/1814* (2013.01); *G03G 5/142* (2013.01); *G03G 5/144* (2013.01)

(58) Field of Classification Search
CPC ..... G03G 5/0525; G03G 5/0507
USPC ..... 430/56, 133; 399/159
See application file for complete search history.

(56) References Cited

U.S. PATENT DOCUMENTS 5,468,584 A 11/1995 Go et al.
5,488,461 A 1/1996 Go et al.

(Continued)

FOREIGN PATENT DOCUMENTS

EP 1 647 997 A1 4/2006
JP 62-187358 A 8/1987

(Continued)

OTHER PUBLICATIONS

PCT International Search Report and Written Opinion of the International Searching Authority, International Application No. JP2012/055888, Mailing Date May 22, 2012.

(Continued)

*Primary Examiner* — Mark A Chapman
(74) *Attorney, Agent, or Firm* — Fitzpatrick, Cella, Harper and Scinto

(57) ABSTRACT

Provided are an electrophotographic photosensitive member in which leakage doesn't easily occur, a process cartridge and an electrophotographic apparatus each including the electrophotographic photosensitive member, and a method of manufacturing the electrophotographic photosensitive member. The electrophotographic photosensitive member includes a conductive layer including titanium oxide particle coated with tin oxide doped with a hetero element. When an absolute value of a maximum current amount flowing through the conductive layer in a case of performing a test of applying −1.0 kV including DC voltage to the conductive layer is defined as Ia, and an absolute value of a current amount flowing through the conductive layer in a case where a decrease ratio of a current amount per minute reaches 1% or less for the first time is defined as Ib, the relations of Ia≤6000 and 10≤Ib are satisfied. A volume resistivity of the conductive layer before the test is $1.0\times10^{8}$ Ω·cm to 5.0×1012 Ω·cm.

6 Claims, 3 Drawing Sheets

(51) Int. Cl.

| | |
|---|---|
| ***G03G 5/10*** | (2006.01) |
| ***G03G 21/18*** | (2006.01) |
| ***G03G 5/14*** | (2006.01) |
| *G03G 5/05* | (2006.01) |

(56) References Cited

U.S. PATENT DOCUMENTS

| | | | |
|---|---|---|---|
| 5,853,936 | A | 12/1998 | Segi et al. |
| 6,156,472 | A | 12/2000 | Segi et al. |
| 6,773,856 | B2 | 8/2004 | Tanaka et al. |
| 7,211,357 | B2 | 5/2007 | Hosoi et al. |
| 7,245,851 | B2 | 7/2007 | Fujii et al. |
| 7,276,318 | B2 | 10/2007 | Fujii et al. |
| 7,333,752 | B2 | 2/2008 | Kawahara et al. |
| 7,407,606 | B2 | 8/2008 | Chiba et al. |
| 7,517,626 | B2 | 4/2009 | Fujii et al. |
| 7,732,113 | B2 | 6/2010 | Nakamura et al. |
| 7,910,274 | B2 | 3/2011 | Tanaka et al. |
| 8,088,541 | B2 | 1/2012 | Tanaka et al. |
| 8,455,170 | B2 | 6/2013 | Nakamura et al. |
| 2006/0234146 | A1 | 10/2006 | Miki et al. |
| 2012/0114375 | A1 | 5/2012 | Fujii et al. |
| 2012/0121291 | A1 | 5/2012 | Tsuji et al. |
| 2012/0301181 | A1 | 11/2012 | Ogaki et al. |
| 2012/0301182 | A1 | 11/2012 | Anezaki et al. |
| 2013/0202326 | A1 | 8/2013 | Shida et al. |
| 2013/0202327 | A1 | 8/2013 | Murai et al. |
| 2013/0236823 | A1 | 9/2013 | Noguchi et al. |
| 2013/0316283 | A1 | 11/2013 | Fujii et al. |
| 2014/0004452 | A1 | 1/2014 | Sekiya et al. |
| 2014/0004453 | A1 | 1/2014 | Kaku et al. |
| 2014/0004454 | A1 | 1/2014 | Okuda et al. |
| 2014/0023962 | A1 | 1/2014 | Okuda et al. |

FOREIGN PATENT DOCUMENTS

| | | | |
|---|---|---|---|
| JP | 6-207118 | A | 7/1994 |
| JP | 6-208238 | A | 7/1994 |
| JP | 6-222600 | A | 8/1994 |
| JP | 10-186702 | A | 7/1998 |
| JP | 2003-316059 | A | 11/2003 |
| JP | 2004-349167 | A | 12/2004 |
| JP | 2007-47736 | A | 2/2007 |
| JP | 4743921 | B1 | 8/2011 |
| WO | 2005/008685 | A1 | 1/2005 |
| WO | 2011/027911 | A1 | 3/2011 |
| WO | 2011/027912 | A1 | 3/2011 |

OTHER PUBLICATIONS

Fujii, et al., U.S. Appl. No. 14/095,955, filed Dec. 3, 2013.

Okuda, et al., U.S. Appl. No. 14/009,721, 371(c) Date: Oct. 3, 2013.

Fujii, et al., U.S. Appl. No. 13/972,688, filed Aug. 21, 2013.

European Search Report dated Jul. 16, 2014 in European Application No. 12752529.3.

ELECTROPHOTOGRAPHIC PHOTOSENSITIVE MEMBER, PROCESS CARTRIDGE AND ELECTROPHOTOGRAPHIC APPARATUS, AND METHOD OF MANUFACTURING ELECTROPHOTOGRAPHIC PHOTOSENSITIVE MEMBER

TECHNICAL FIELD

The present invention relates to an electrophotographic photosensitive member, a process cartridge and an electrophotographic apparatus each including the electrophotographic photosensitive member, and a method of manufacturing the electrophotographic photosensitive member.

BACKGROUND ART

An electrophotographic photosensitive member using an organic photo-conductive material (organic electrophotographic photosensitive member) has been intensively studied and developed in recent years.

The electrophotographic photosensitive member basically includes a support and a photosensitive layer formed on the support. In actuality, however, various layers are provided in many cases between the support and the photosensitive layer for the purposes of, for example, covering defects of the surface of the support, protecting the photosensitive layer from electrical destruction, enhancing chargeability, and improving charge injection blocking property from the support to the photosensitive layer.

Of the layers to be provided between the support and the photosensitive layer, a layer containing a metal oxide particle is known as a layer to be provided for the purpose of covering defects of the surface of the support. The layer containing a metal oxide particle generally has high conductivity (for example, a volume resistivity of $1.0\times10^{8}$ to $5.0\times10^{12}$ Ω·cm) as compared to that of a layer not containing metal oxide particle, and even when the thickness of the layer is increased, a residual potential at the time of forming an image is difficult to increase. Therefore, the layer containing a metal oxide particle covers defects of the surface of the support easily. When such layer having high conductivity (hereinafter, referred to as "conductive layer") is provided between the support and the photosensitive layer to cover defects of the surface of the support, an allowable range of defects of the surface of the support is enlarged. As a result, an allowable range of the support to be used is enlarged. Thus, an advantage of enhancing productivity of an electrophotographic photosensitive member is provided.

Patent Literature 1 discloses a technology including using a tin oxide particle doped with phosphorus in an intermediate layer between a support and a photo-conductive layer. Further, Patent Literature 2 discloses a technology including using a tin oxide particle doped with tungsten in a protective layer on a photosensitive layer. Further, Patent Literature 3 discloses a technology including using titanium oxide particle coated with oxygen deficient tin oxide in a conductive layer between a support and a photosensitive layer. Further, Patent Literature 4 discloses a technology including using a barium sulfate particle covered with tin oxide in an intermediate layer between a support and a photosensitive layer.

CITATION LIST

Patent Literature

PTL 1: Japanese Patent Application Laid-Open No. H06-222600

PTL 2: Japanese Patent Application Laid-Open No. 2003-316059

PTL 3: Japanese Patent Application Laid-Open No. 2007-47736

PTL 4: Japanese Patent Application Laid-Open No. H06-208238

SUMMARY OF INVENTION

Technical Problem

However, as a result of the studies made by the inventors of the present invention, it was found that, when images are formed repeatedly under an environment of low temperature and low humidity, using an electrophotographic photosensitive member that adopts the layer containing a metal oxide particle as a conductive layer, leakage is liable to occur in the electrophotographic photosensitive member. The leakage refers to a phenomenon in which insulation breakdown occurs in a local part of the electrophotographic photosensitive member, and an excess current flow through the local part. When the leakage occurs, the electrophotographic photosensitive member cannot be charged sufficiently, leading to defects of an image such as black spots, white lateral streaks, and black lateral streaks.

The present invention is directed to provide an electrophotographic photosensitive member in which leakage does not easily occur even when the electrophotographic photosensitive member adopts a layer containing a metal oxide particle as a conductive layer, a process cartridge and an electrophotographic apparatus each including the electrophotographic photosensitive member, and a method of manufacturing the electrophotographic photosensitive member.

Solution to Problem

According to one aspect of the present invention, there is provided an electrophotographic photosensitive member, comprising: a cylindrical support; a conductive layer including a binder material and a metal oxide particle formed on the cylindrical support; and a photosensitive layer formed on the conductive layer, wherein the metal oxide particle is a titanium oxide particle coated with tin oxide doped with a hetero element; when an absolute value of the maximum current amount flowing through the conductive layer in the case of performing a test of continuously applying a voltage of −1.0 kV including only a DC voltage to the conductive layer is defined as Ia [μA], and an absolute value of a current amount flowing through the conductive layer in a case where a decrease ratio of a current amount per one minute flowing through the conductive layer reaches 1% or less for the first time is defined as Ib [μA], the Ia and the Ib satisfy the following relations (i) and (ii); and $$Ia\leq6000 \quad \text{(i); and}$$

$$10\leq Ib \quad \text{(ii),}$$

a volume resistivity of the conductive layer before the test is performed is from $1.0\times10^{8}$ to $5.0\times10^{12}$ Ω·cm.

According to another aspect of the present invention, there is provided a process cartridge detachably attachable to a main body of an electrophotographic apparatus, wherein the process cartridge integrally supports: the above-described electrophotographic photosensitive member; and at least one device selected from the group consisting of a charging device, a developing device, a transferring device, and a cleaning device.

According to further aspect of the present invention, there is provided an electrophotographic apparatus, comprising: the above-described electrophotographic photosensitive member, a charging device, an exposing device, a developing device, and a transferring device.

According to still further aspect of the present invention, there is provided a method of manufacturing an electrophotographic photosensitive member, the method comprising: the step of forming a conductive layer with a volume resistivity of $1.0\times10^{8}$ Ω·cm or more to $5.0\times10^{12}$ Ω·cm or less on a cylindrical support; and the step of forming a photosensitive layer on the conductive layer, wherein, the step of forming the conductive layer comprises: preparing a coating liquid for the conductive layer by use of: a solvent, a binder material, and a metal oxide particle with a powder resistivity of $1.0\times10^{3}$ to $1.0\times10^{5}$ Ω·cm, and forming the conductive layer by use of the coating liquid for the conductive layer; a mass ratio (P/B) of the metal oxide particle (P) to the binder material (B) in the coating liquid for the conductive layer, is from 1.5/1.0 to 3.5/1.0; and the metal oxide particle is a titanium oxide particle coated with tin oxide doped with phosphorus.

Advantageous Effects of Invention

According to the present invention, it is possible to provide the electrophotographic photosensitive member in which leakage does not easily occur even when the electrophotographic photosensitive member adopts a layer containing a metal oxide particle as a conductive layer, the process cartridge and the electrophotographic apparatus each including the electrophotographic photosensitive member, and the method of manufacturing the electrophotographic photosensitive member.

Further features of the present invention will become apparent from the following description of exemplary embodiments with reference to the attached drawings.

DESCRIPTION OF EMBODIMENTS

An electrophotographic photosensitive member of the present invention includes a cylindrical support (hereinafter, also simply referred to as "support"), a conductive layer formed on the cylindrical support, and a photosensitive layer formed on the conductive layer. The photosensitive layer may be a single photosensitive layer containing a charge generating material and a charge transporting material in a single layer or may be a laminated photosensitive layer in which a charge generation layer containing a charge generating material and a charge transport layer containing a charge transporting material are laminated. Further, if required, an undercoat layer may be provided between the conductive layer and the photosensitive layer formed on the cylindrical support.

The support is preferably conductive (conductive support), and a support made of a metal such as aluminum, an aluminum alloy, and stainless steel may be used. In the case of using aluminum or an aluminum alloy, an aluminum tube produced by a production method including an extrusion and a drawing or an aluminum tube produced by a production method including an extrusion and an ironing can be used. Such aluminum tube provides satisfactory dimensional accuracy and surface smoothness without cutting of the surface, and is hence advantageous in terms of cost as well. However, on the uncut surface of the aluminum tube, burr-like protruding defects are liable to occur. Hence, it is particularly effective to provide the conductive layer.

In the present invention, for the purpose of covering defects of the surface of the support, the conductive layer having a volume resistivity of $1.0\times10^{8}$ Ω·cm or more to $5.0\times10^{12}$ Ω·cm or less is provided on the support. It should be noted that, in the case of performing a DC voltage continuous application test to be described later, the volume resistivity of the conductive layer refers to a volume conductivity measured before the DC voltage continuous application test is performed. When a layer having a volume resistivity exceeding $5.0\times10^{12}$ Ω·cm is provided on the support as a layer for covering defects of the surface of the support, the flow of charge is liable to be disrupted at the time of formation of an image and a residual potential is liable to increase. On the other hand, when the volume resistivity of the conductive layer is less than $1.0\times10^{8}$ Ω·cm, a charge amount flowing through the conductive layer increases excessively, and leakage is liable to occur.

Figure 2:
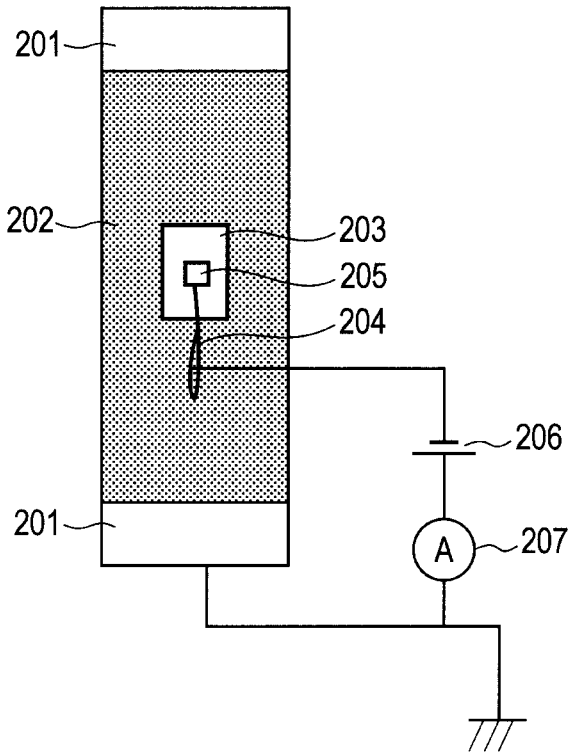
FIG. 2 is a view (top view) illustrating a method of measuring a volume resistivity of a conductive layer.
Figure 3:
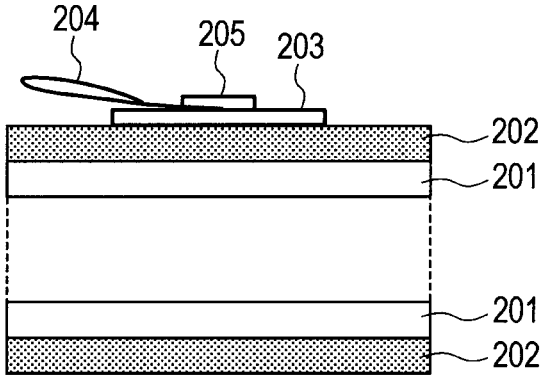
FIG. 3 is a view (cross-sectional view) illustrating a method of measuring a volume resistivity of a conductive layer.

A method of measuring a volume resistivity of the conductive layer of the electrophotographic photosensitive member is described with reference to FIGS. 2 and 3. FIG. 2 is a top view illustrating a method of measuring a volume resistivity of the conductive layer, and FIG. 3 is a cross-sectional view illustrating a method of measuring a volume resistivity of the conductive layer.

The volume resistivity of the conductive layer is measured under an environment of normal temperature and normal humidity (23° C./50% RH). A copper tape 203 (Type No. 1181 manufactured by Sumitomo 3M Limited) is attached to the surface of a conductive layer 202, and used as an electrode on the front surface side of the conductive layer 202. Further, a support 201 is used as an electrode on the back side of the conductive layer 202. A power source 206 for applying a voltage between the copper tape 203 and the support 201 and a current measurement appliance 207 for measuring a current flowing between the copper tape 203 and the support 201 are respectively set. Further, in order to apply a voltage to the copper tape 203, a copper wire 204 is placed on the copper tape 203, and a copper tape 205 similar to the copper tape 203 is attached from above the copper wire 204 so that the copper wire 204 does not protrude to the copper tape 203, whereby the copper wire 204 is fixed to the copper tape 203. A voltage is applied to the copper tape 203 through the copper wire 204.

When a background current value obtained in the case where a voltage is not applied between the copper tape 203 and the support 201 is defined as $I_0$ [A], a current value obtained in the case where a voltage of −1 V including only a DC voltage (DC component) is applied is defined as I [A], a thickness of the conductive layer 202 is defined as d [cm], and an area of the electrode (copper tape 203) on the front surface side of the conductive layer 202 is defined as S [$cm^2$], a value represented by the following mathematical expression (1) is defined as a volume resistivity p [Ω·cm] of the conductive layer 202.

$$\rho=1/(I-I_0)\times S/d\ [\Omega\cdot cm] \quad (1)$$

In this measurement, a minute current value of $1\times10^{-6}$ A or less in an absolute value is measured, and hence, it is preferred to use an appliance capable of measuring a minute current as the current measurement appliance 207. An example of such appliance is a pA meter (trade name: 4140B) manufactured by Hewlett-Packard Japan, Ltd.

It should be noted that the volume resistivity of the conductive layer measured in a state in which only the conductive layer is formed on the support is substantially the same as that measured in a state in which each layer (e.g., photosensitive layer) on the conductive layer is peeled from the electrophotographic photosensitive member to leave only the conductive layer on the support.

The conductive layer can be formed using a coating liquid for the conductive layer prepared using a solvent, a binder material, and a metal oxide particle. Further, in the present invention, as the metal oxide particle, titanium oxide particle coated with tin oxide doped with a hetero element (hereinafter, also referred to as "titanium oxide particle coated with tin oxide") is used. Of the titanium oxide particle coated with tin oxide doped with a hetero element, titanium oxide ($TiO_2$) particle coated with tin oxide ($SnO_2$) doped with phosphorus (P) is used preferably.

The coating liquid for the conductive layer can be prepared by dispersing a metal oxide particle (titanium oxide particle coated with tin oxide) in a solvent together with a binder material. As a dispersion method, there are given, for example, methods using a paint shaker, a sand mill, a ball mill, and a liquid collision type high-speed disperser. The conductive layer can be formed by coating the support with the coating liquid for the conductive layer prepared as described above, and drying and/or curing the coated film of the coating liquid for the conductive layer.

Further, from the viewpoints of enhancing leakage resistance and suppressing an increase in residual potential, when an absolute value of the maximum current amount flowing through the conductive layer in the case of performing a test of continuously applying a voltage of −1.0 kV including only a DC voltage (DC component) to the conductive layer (also referred to as "DC voltage continuous application test") is defined as Ia [μA], and an absolute value of a current amount flowing through the conductive layer in the case where a decrease ratio of a current amount per minute flowing through the conductive layer reaches 1% or less for the first time is defined as Ib [μA], it is preferred that Ia and Ib satisfy the following relations (i) and (ii). The detail of the DC voltage continuous application test is described later.

$$Ia\leq6000 \quad (i)$$

$$10\leq Ib \quad (ii)$$

Hereinafter, Ia, the absolute value of the maximum current amount, is also referred to as "maximum amount of current Ia," and Ib, the absolute value of the current amount, is also referred to as "amount of current Ib."

When the maximum current amount Ia flowing through the conductive layer exceeds 6,000 μA, leakage resistance of the electrophotographic photosensitive member is liable to decrease. It is considered that, in the conductive layer whose maximum current amount Ia exceeds 6,000 μA, an excessive current is liable to flow locally, and insulation breakdown, which causes leakage, is liable to occur. In order to further enhance leakage resistance, it is preferred that the maximum current amount Ia be 5,000 μA or less (Ia≤5000 . . . (iii)).

On the other hand, when the current amount Ib flowing through the conductive layer is less than 10 μA, the residual potential of the electrophotographic photosensitive member at the time of formation of an image is liable to increase. It is considered that the flow of charge is liable to be disrupted causing an increase in residual potential in the conductive layer hose current amount Ib is less than 10 μA. In order to further suppress an increase in residual potential, it is preferred that the amount of current Ib be 20 μA or more (20≤Ib . . . (iv)).

Further, from the viewpoints of enhancing leakage resistance and setting the maximum current amount Ia to 6,000 μA or less, it is preferred that the powder resistivity of titanium oxide particle coated with tin oxide used as the metal oxide particle in the conductive layer be $1.0\times10^3$ Ω·cm or more.

When the powder resistivity of the titanium oxide particle coated with tin oxide is less than $1.0\times10^3$ Ω·cm, leakage resistance of the electrophotographic photosensitive member is liable to decrease. This is probably because the state of a conductive path in the conductive layer formed of the titanium oxide particle coated with tin oxide varies depending upon the powder resistivity of the titanium oxide particle coated with tin oxide. When the powder resistivity of the titanium oxide particle coated with tin oxide is less than $1.0\times10^3$ Ω·cm, a charge amount flowing through each of the titanium oxide particle coated with tin oxide tends to increase. On the other hand, when the powder resistivity of the titanium oxide particle coated with tin oxide is $1.0\times10^3$ Ω·cm or more, a charge amount flowing through each of the titanium oxide particle coated with tin oxide tends to decrease. Specifically, it is considered that, irrespective of whether the conductive layer is one formed using the titanium oxide particle coated with tin oxide whose powder resistivity is less than $1.0\times10^3$ Ω·cm, or one formed using the titanium oxide particle coated with tin oxide whose powder resistivity is $1.0\times10^3$ Ω·cm or more, when the volume resistivities of both the conductive layers are the same, the total charge amount flowing through one of the conductive layers is the same as that of the other conductive layer. When the total charge amount flowing through the conductive layer is the same, a charge amount flowing through each of the titanium oxide particle coated with tin oxide varies between the titanium oxide particle coated with tin oxide whose powder resistivity is less than $1.0\times10^3$ Ω·cm and the titanium oxide particle coated with tin oxide whose powder resistivity is $1.0\times10^3$ Ω·cm or more.

This means that the number of conductive paths in the conductive layer varies between the conductive layer formed using the titanium oxide particle coated with tin oxide whose powder resistivity is less than $1.0\times10^3$ Ω·cm and the conductive layer formed using the titanium oxide particle coated with tin oxide whose powder resistivity is $1.0\times10^3$ Ω·cm or more. Specifically, it is conjectured that the number of conductive paths in the conductive layer is larger in the conductive layer formed using the titanium oxide particle coated with tin oxide whose powder resistivity is $1.0\times10^3$ Ω·cm or more, than in the conductive layer formed using the titanium oxide particle coated with tin oxide whose powder resistivity is less than $1.0\times10^3$ Ω·cm.

Thus, it is considered that in the case of forming the conductive layer using the titanium oxide particle coated with tin oxide whose powder resistivity is $1.0\times10^3$ Ω·cm or more, a charge amount flowing per one conductive path in the conductive layer becomes relatively small, and an excess current is suppressed from flowing locally in each conductive path, which leads to the enhancement of leakage resistance of the electrophotographic photosensitive member. In order to further enhance leakage resistance, it is preferred that the powder resistivity of the titanium oxide particle coated with tin oxide used as the metal oxide particle in the conductive layer be $3.0\times10^3$ Ω·cm or more.

Further, from the viewpoints of suppressing an increase in residual potential and setting the current amount Ib to 10 μA or more, it is preferred that the powder resistivity of the titanium oxide particle coated with tin oxide used as the metal oxide particle in the conductive layer be $1.0\times10^5$ Ω·cm or less.

When the powder resistivity of the titanium oxide particle coated with tin oxide exceeds $1.0\times10^5$ Ω·cm, the residual potential of the electrophotographic photosensitive member is liable to increase at the time of formation of an image. Further, it becomes difficult to adjust the volume resistivity of the conductive layer to $5.0\times10^{12}$ Ω·cm or less. In order to further suppress an increase in residual potential, it is preferred that the powder resistivity of the titanium oxide particle coated with tin oxide used as the metal oxide particle in the conductive layer be $5.0\times10^4$ Ω·cm or less.

For those reasons, the powder resistivity of the titanium oxide particle coated with tin oxide used as the metal oxide particle in the conductive layer is preferably $1.0\times10^3$ Ω·cm or more to $1.0\times10^5$ Ω·cm or less, more preferably $3.0\times10^3$ Ω·cm or more to $5.0\times10^4$ Ω·cm or less.

The titanium oxide particle coated with tin oxide not only have a large effect of enhancing leakage resistance of the electrophotographic photosensitive member, but also a large effect of suppressing an increase in residual potential at the time of formation of an image as compared to titanium oxide ($TiO_2$) particle coated with oxygen deficient tin oxide ($SnO_2$) (hereinafter, also referred to as "titanium oxide particle coated with oxygen deficient tin oxide"). The reason why the titanium oxide particle coated with tin oxide has a large effect of enhancing leakage resistance is considered as described below. That is, the conductive layer using the titanium oxide particle coated with tin oxide as the metal oxide particle has a small maximum current amount Ia and a high pressure resistance as compared to the conductive layer using the titanium oxide particle coated with oxygen deficient tin oxide. Further, the reason why the titanium oxide particle coated with tin oxide has a large effect of suppressing an increase in residual potential at the time of formation of an image is considered as described below. That is, the titanium oxide particle coated with oxygen deficient tin oxide is oxidized in the presence of oxygen to disappear an oxygen deficient site in tin oxide ($SnO_2$), the resistance of the particle increases, and the flow of charge in the conductive layer is liable to be disrupted, whereas the titanium oxide particle coated with tin oxide is difficult to cause such phenomenon.

It is preferred that the ratio (coverage) of tin oxide ($SnO_2$) in the titanium oxide particle coated with tin oxide be 10 to 60% by mass. In order to control the coverage of tin oxide ($SnO_2$), it is necessary to blend a tin raw material required for generating tin oxide ($SnO_2$) in producing the titanium oxide particle coated with tin oxide. For example, in the case of using tin chloride ($SnCl_4$) as the tin raw material, it is necessary to blend tin chloride in consideration of the amount of tin oxide ($SnO_2$) generated from tin chloride ($SnCl_4$). It should be noted that the coverage in this case is a value calculated from a mass of tin oxide ($SnO_2$) based on the total mass of tin oxide ($SnO_2$) and titanium oxide ($TiO_2$) without considering a mass of a hetero element (e.g., phosphorus (P)) with which tin oxide ($SnO_2$) is doped. When the coverage of tin oxide ($SnO_2$) is less than 10% by mass, it becomes difficult to adjust the powder resistivity of the titanium oxide particle coated with tin oxide to $1.0\times10^5$ Ω·cm or less. When the coverage is more than 60% by mass, the coating of a titanium oxide ($TiO_2$) particle with tin oxide ($SnO_2$) is liable to be non-uniform, entailing high cost, and it is difficult to adjust the powder resistivity of the titanium oxide particle coated with tin oxide to $1.0\times10^3$ Ω·cm or more.

Further, it is preferred that the amount of a hetero element (e.g., phosphorus (P)) with which tin oxide ($SnO_2$) is doped be 0.1 to 10% by mass with respect to tin oxide ($SnO_2$) (mass containing no hetero element (e.g., phosphorus (P)). When the amount of a hetero element (e.g., phosphorus (P)) with which tin oxide ($SnO_2$) is doped is less than 0.1% by mass, it becomes difficult to adjust the powder resistivity of the titanium oxide particle coated with tin oxide to $1.0\times10^5$ Ω·cm or less. When the amount of a hetero element (e.g., phosphorus (P)) with which tin oxide ($SnO_2$) is doped is more than 10% by mass, the crystallinity of tin oxide ($SnO_2$) decreases, and it becomes difficult to adjust the powder resistivity of the titanium oxide particle coated with tin oxide to $1.0\times10^3$ Ω·cm or more ($1.0\times10^5$ Ω·cm or less). In general, a smaller powder resistivity of the particle can be achieved by doping tin oxide ($SnO_2$) with a hetero element (e.g., phosphorus (P)) than that in the case of doping with no hetero element.

It should be noted that a method of producing the titanium oxide particle coated with tin oxide ($SnO_2$) doped with phosphorus (P) is also disclosed in Japanese Patent Application Laid-Open Nos. H06-207118 and 2004-349167.

A method of measuring the powder resistivity of the metal oxide particle such as the titanium oxide particle coated with tin oxide is as follows.

The powder resistivity of the metal oxide particle is measured under an environment of normal temperature and normal humidity (23° C./50% RH). In the present invention, a resistivity meter (Trade name: Loresta GP) manufactured by Mitsubishi Chemical Corporation is used as a measurement apparatus. The metal oxide particle to be measured was pelletized under a pressure of 500 kg/cm$^2$ to obtain a pellet sample for measurement. A voltage to be applied is 100 V.

In the present invention, the reason why the titanium oxide particle coated with tin oxide having core particle (titanium oxide particle ($TiO_2$)) is used as the metal oxide particle in the conductive layer is to enhance the dispersibility of the metal oxide particle in a coating liquid for the conductive layer. In the case of using particle formed of only tin oxide ($SnO_2$) doped with a hetero element (e.g., phosphorus (P)), the particle diameter of each of the metal oxide particle in the coating liquid for the conductive layer is liable to increase, and as a result, protrusive seeding defects may occur in the surface of the conductive layer, leakage resistance may decrease, and the stability of the coating liquid for the conductive layer may decrease.

Further, the reasons why the titanium oxide ($TiO_2$) particle is used as the core particle are as described below. That is, the titanium oxide particle can easily enhance leakage resistance, and can easily cover defects of the surface of the support because the particle is low in transparency as the metal oxide particle. In contrast, for example, in the case of using a barium sulfate particle as the core particle, a charge amount flowing through the conductive layer is liable to increase, which makes it difficult to enhance leakage resistance. Further, the barium sulfate particle is high in transparency as the metal oxide particle, and hence a material for covering defects of the surface of the support may be required separately.

Further, the reason why the titanium oxide ($TiO_2$) particle coated with tin oxide ($SnO_2$) doped with a hetero element (e.g., phosphorus (P)) is used instead of a non-coated titanium oxide ($TiO_2$) particle as the metal oxide particle is that, in the non-coated titanium oxide ($TiO_2$) particle, a flow of charge is liable to be disrupted at the time of formation of an image, and a residual potential is liable to increase.

Examples of the binder material to be used for preparing the coating liquid for the conductive layer include resins such as a phenol resin, polyurethane, polyamide, polyimide, polyamide-imide, polyvinyl acetal, an epoxy resin, an acrylic resin, a melamine resin, and polyester. The resins may be used alone or in combination of two or more kinds thereof. Further, of those resins, from the viewpoints of, for example, suppression of migration (transfer) into another layer, adhesiveness with the support, dispersibility and dispersion stability of the titanium oxide particle coated with tin oxide, and solvent resistance after layer formation, a curable resin is preferred, and a thermosetting resin is more preferred. Further, of the thermosetting resins, a thermosetting phenol resin and thermosetting polyurethane are preferred. In the case of using the thermosetting resin as the binder material in the conductive layer, the binder material to be contained in the coating liquid for the conductive layer is a monomer and/or an oligomer of the thermosetting resin.

Examples of the solvent to be used for the coating liquid for the conductive layer include alcohols such as methanol, ethanol, and isopropanol, ketones such as acetone, methyl ethyl ketone, and cyclohexanone, ethers such as tetrahydrofuran, dioxane, ethylene glycol monomethyl ether, and propylene glycol monomethyl ether, esters such as methyl acetate and ethyl acetate, and aromatic hydrocarbons such as toluene and xylene.

Further, in the present invention, it is preferred that the mass ratio (P/B) of metal oxide particle (titanium oxide particle coated with tin oxide) (P) to a binder material (B) in the coating liquid for the conductive layer be 1.5/1.0 or more to 3.5/1.0 or less. When the mass ratio (P/B) is less than 1.5/1.0, a flow of charge is liable to be disrupted at the formation of an image, and a residual potential is liable to increase. Further, it becomes difficult to adjust the volume resistivity of the conductive layer to $5.0\times10^{12}$ Ω·cm or less. When the mass ratio (P/B) is more than 3.5/1.0, it becomes difficult to adjust the volume resistivity of the conductive layer to $1.0\times10^{8}$ Ω·cm or more. Further, it becomes difficult to bind the metal oxide particle (titanium oxide particle coated with tin oxide), a crack is liable to occur in the conductive layer, and leakage resistance is hardly enhanced.

From the viewpoint of covering defects of the surface of the support, the thickness of the conductive layer is preferably 10 μm or more to 40 μm or less, more preferably 15 μm or more to 35 μm or less. It should be noted that, in the present invention, as an apparatus for measuring the thickness of each layer of the electrophotographic photosensitive member including the conductive layer, FISCHERSCOPE MMS manufactured by Fischer Instruments K.K. was used.

Further, the average particle diameter of the titanium oxide particles coated with tin oxide in the coating liquid for the conductive layer is preferably 0.10 μm or more to 0.45 μm or less, more preferably 0.15 μm or more to 0.40 μm or less. When the average particle diameter is less than 0.10 μm, the titanium oxide particle coated with tin oxide aggregate again after the coating liquid for the conductive layer is prepared, the stability of the coating liquid for the conductive layer may be degraded, and a crack may occur in the surface of the conductive layer. When the average particle diameter is more than 0.45 μm, the surface of the conductive layer is roughened, a charge is liable to be injected locally in the photosensitive layer, and black spots on a white background of an output image may become conspicuous.

The average particle diameter of the metal oxide particle such as the titanium oxide particle coated with tin oxide in the coating liquid for the conductive layer can be measured by a liquid phase sedimentation method as described below.

First, a coating liquid for the conductive layer is diluted with a solvent used for the preparation thereof so that the transmittance falls within a range of 0.8 and 1.0. Then, a histogram of an average particle diameter (volume standard: D50) and a particle size distribution of the metal oxide particle is prepared by using an ultracentrifugal automatic particle size distribution analyzer. In the present invention, as the ultracentrifugal automatic particle size distribution analyzer, an ultracentrifugal automatic particle size distribution analyzer (trade name: CAPA 700) manufactured by Horiba, Ltd. was used, and measurement was carried out under the condition of a rotation number of 3,000 rpm.

Further, in order to prevent interference fringes from being generated on an output image owing to interference of light reflected on the surface of the conductive layer, the coating liquid for the conductive layer may contain a surface-roughness imparting agent for roughening the surface of the conductive layer. As the surface-roughness imparting agent, resin particles each having an average particle diameter of 1 μm or more to 5 μm or less are preferred. Examples of the resin particles include particles of curable resins such as curable rubber, polyurethane, an epoxy resin, an alkyd resin, a phenol resin, polyester, a silicone resin, and an acryl-melamine resin. Of those, particles of a silicone resin, which are difficult to aggregate, are preferred. As the gravity (0.5 to 2) of the resin particles is smaller than that (4 to 7) of the titanium oxide particles coated with tin oxide, the surface of the conductive layer can be roughened efficiently at the time of formation of the conductive layer. It should be noted that, as the content of the surface-roughness imparting agent in the conductive layer is larger, the volume resistivity of the conductive layer tends to increase. Therefore, in order to adjust the volume resistivity of the conductive layer to $5.0\times10^{12}$ Ω·cm or less, it is preferred that the content of the surface-roughness imparting agent in the coating liquid for the conductive layer be 1 to 80% by mass with respect to the binder material in the coating liquid for the conductive layer.

Further, the coating liquid for the conductive layer may contain a leveling agent for enhancing the surface property of the conductive layer. Further, the coating liquid for the conductive layer may contain pigment particles for enhancing the covering property of the conductive layer.

In order to prevent the injection of a charge from the conductive layer to the photosensitive layer, an undercoat layer (barrier layer) having electric barrier property may be provided between the conductive layer and the photosensitive layer.

The undercoat layer can be formed by coating the conductive layer with a coating liquid for the undercoat layer containing a resin (binder resin) and drying the coated film of the coating liquid for the undercoat layer.

Examples of the resin (binder resin) to be used in the undercoat layer include polyvinyl alcohol, polyvinyl methyl ether, polyacrylic acids, methylcellulose, ethylcellulose, polyglutamic acid, casein, starch, and other water-soluble resins, polyamide, polyimide, polyamide-imide, polyamide acid, a melamine resin, an epoxy resin, polyurethane, and polyglutamic acid esters. Of those, thermoplastic resins are preferred to effectively express the electric barrier property of the undercoat layer. Of the thermoplastic resins, thermoplastic polyamide is preferred. The polyamide is preferably copolymerized nylon.

The thickness of the undercoat layer is preferably 0.1 μm or more to 2.0 μm or less.

In addition, an electron transport substance (electron-accepting substance such as an acceptor) may be contained in the undercoat layer to prevent the flow of charge from being disrupted in the undercoat layer. Examples of the electron transport substance include electron-withdrawing substances such as 2,4,7-trinitrofluorenone, 2,4,5,7-tetranitrofluorenone, chloranil, and tetracyanoquinodimethane, and polymers of those electron-withdrawing substances.

The photosensitive layer is provided on the conductive layer (undercoat layer).

Examples of the charge generating material to be used in the photosensitive layer include: azo pigments such as monoazo, disazo, and trisazo; phthalocyanine pigments such as metal phthalocyanine and nonmetal phthalocyanine; indigo pigments such as indigo and thioindigo; perylene pigments such as perylene acid anhydride and perylene acid imide; polycyclic quinone pigments such as anthraquinone and pyrenequinone; squarylium dyes; pyrylium salts and thiapyrylium salts; triphenylmethane dyes; quinacridone pigments; azulenium salt pigments; cyanine dyes; xanthene dyes; quinonimine dyes; and styryl dyes. Of those, metal phthalocyanines such as oxytitanium phthalocyanine, hydroxygallium phthalocyanine, and chlorogallium phthalocyanine are preferred.

When the photosensitive layer is a laminated photosensitive layer, the charge generation layer can be formed by applying a coating liquid for the charge generation layer, which is prepared by dispersing a charge generating material into a solvent together with a binder resin, and then drying the coating film of the coating liquid for the charge generation layer. As a dispersion method, there are given, for example, methods using a homogenizer, an ultrasonic wave, a ball mill, a sand mill, an attritor, and a roll mill.

Examples of the binder resin to be used in the charge generation layer include polycarbonate, polyester, polyarylate, a butyral resin, polystyrene, polyvinyl acetal, a diallylphthalate resin, an acryl resin, a methacryl resin, a vinyl acetate resin, a phenol resin, a silicone resin, polysulfone, a styrene-butadiene copolymer, an alkyd resin, an epoxy resin, a urea resin, and a vinyl chloride-vinyl acetate copolymer. Those binding resins may be used alone or as a mixture or a copolymer of two or more kinds thereof.

The ratio of the charge generating material to the binder resin (charge generating material: binder resin) falls within a range of preferably 10:1 to 1:10 (mass ratio), more preferably 5:1 to 1:1 (mass ratio).

Examples of the solvent to be used in the coating liquid for the charge generation layer include an alcohol, a sulfoxide, a ketone, an ether, an ester, an aliphatic halogenated hydrocarbon, and an aromatic compound.

The thickness of the charge generation layer is preferably 5 μm or less, more preferably 0.1 μm or more to 2 μm or less.

Further, any of various sensitizers, antioxidants, UV absorbers, plasticizers, and the like may be added to the charge generation layer, if required. Further, an electron transport substance (electron-accepting substance such as an acceptor) may be contained in the charge generation layer to prevent the flow of charge from being disrupted in the charge generation layer. Examples of the electron transport substance include electron-withdrawing substances such as 2,4,7-trinitrofluorenone, 2,4,5,7-tetranitrofluorenone, chloranil, and tetracyanoquinodimethane, and polymers of those electron-withdrawing substances.

Examples of the charge transporting material to be used in the photosensitive layer include a triarylamine compound, a hydrazone compound, a styryl compound, a stilbene compound, a pyrazoline compound, an oxazole compound, a thiazole compound, and a triallylmethane compound.

When the photosensitive layer is a laminated photosensitive layer, the charge transport layer can be formed by applying a coating liquid for the charge transport layer, which is prepared by dissolving a charge transporting material and a binder resin in a solvent, and then drying the coating film of the coating liquid for the charge transport layer.

Examples of the binder resin to be used in the charge transport layer include an acryl resin, a styrene resin, polyester, polycarbonate, polyarylate, polysulfone, polyphenylene oxide, an epoxy resin, polyurethane, an alkyd resin, and an unsaturated resin. Those binder resins may be used alone or as a mixture or a copolymer of two or more kinds thereof.

The ratio of the charge transporting material to the binder resin (charge transporting material: binder resin) preferably falls within a range of 2:1 to 1:2 (mass ratio).

Examples of the solvent to be used in the coating liquid for the charge transport layer include: ketones such as acetone and methyl ethyl ketone; esters such as methyl acetate and ethyl acetate; ethers such as dimethoxymethane and dimethoxyethane; aromatic hydrocarbons such as toluene and xylene; and hydrocarbons each substituted by a halogen atom, such as chlorobenzene, chloroform, and carbon tetrachloride.

The thickness of the charge transport layer is preferably 3 μm or more to 40 μm or less, more preferably 4 μm or more to 30 μm or less from the viewpoints of charging uniformity and image reproducibility.

Further, an antioxidant, a UV absorber, or a plasticizer may be added to the charge transport layer, if required.

When the photosensitive layer is a single photosensitive layer, the single photosensitive layer can be formed by applying a coating liquid for the single photosensitive layer containing a charge generating material, a charge transporting material, a binder resin, and a solvent, and then drying the coating film of the coating liquid for the single photosensitive layer. As the charge generating material, the charge transporting material, the binder resin, and the solvent, for example, those of various kinds described above can be used.

Further, a protective layer may be formed on the photosensitive layer to protect the photosensitive layer.

The protective layer can be formed by applying a coating liquid for the protective layer containing a resin (binder resin), and then drying and/or curing the coating film of the coating liquid for the protective layer.

The thickness of the protective layer is preferably 0.5 μm or more to 10 μm or less, more preferably 1 μm or more to 8 μm to less.

In the application of each of the coating liquids corresponding to the respective layers, application methods such as dip coating method (immersion coating method), spray coating, spinner coating, roller coating, Meyer bar coating, and blade coating may be employed.

Figure 1:
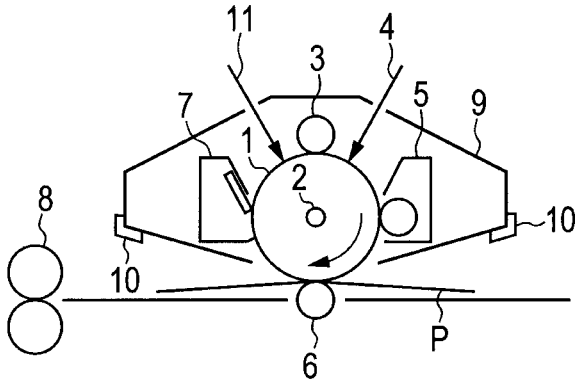
FIG. 1 is a view illustrating an example of a schematic configuration of an electrophotographic apparatus including a process cartridge having an electrophotographic photosensitive member.

FIG. 1 illustrates an example of a schematic configuration of an electrophotographic apparatus including a process cartridge having an electrophotographic photosensitive member.

In FIG. 1, an electrophotographic photosensitive member 1 having a drum shape (cylindrical shape) can be driven to rotate around an axis 2 in a direction indicated by the arrow at predetermined peripheral speed.

The circumferential surface of the electrophotographic photosensitive member 1 to be driven to rotate is uniformly charged at a positive or negative predetermined potential by a charging device (such as a primary charging device or a charging roller) 3, and then receives exposure light (image exposure light) 4 emitted from an exposing device (not shown) such as a slit exposure or a laser-beam scanning exposure. Thus, electrostatic latent images corresponding to the respective images of interest are sequentially formed on the circumferential surface of the electrophotographic photosensitive member 1. A voltage to be applied to the charging device 3 may be only a DC voltage, or may be a DC voltage superimposed with an AC voltage.

The electrostatic latent images formed on the circumferential surface of the electrophotographic photosensitive member 1 are developed by toner of a developing device 5 to form toner images. Subsequently, the toner images formed on the circumferential surface of the electrophotographic photosensitive member 1 are transferred onto a transfer material (such as paper) P by a transfer bias from a transferring device (such as a transfer roller) 6. The transfer material P is fed from a transfer material feeding device (not shown) to a portion (abutment portion) between the electrophotographic photosensitive member 1 and the transfer device 6 in synchronization with the rotation of the electrophotographic photosensitive member 1.

The transfer material P having the toner images transferred is separated from the circumferential surface of the electrophotographic photosensitive member 1, introduced to a fixing device 8, subjected to image fixation, and then printed as an image-formed product (print or copy) out of the apparatus.

The circumferential surface of the electrophotographic photosensitive member 1 after the transfer of the toner images undergoes removal of the remaining toner after the transfer by a cleaning device (such as a cleaning blade) 7. Further, the circumferential surface of the electrophotographic photosensitive member 1 is subjected to a neutralization process with pre-exposure light 11 from a pre-exposing device (not shown) and then repeatedly used for image formation. It should be noted that, when the charging device is a contact-charging device using a charging roller, the pre-exposure is not always required.

The electrophotographic photosensitive member 1 and at least one component selected from the charging device 3, the developing device 5, the transferring device 6, the cleaning device 7, and the like may be accommodated in a container and then integrally supported as a process cartridge. In addition, the process cartridge may be detachably attached to the main body of the electrophotographic apparatus. In FIG. 1, the electrophotographic photosensitive member 1, and the charging device 3, the developing device 5, and the cleaning device 7 are integrally supported to form a cartridge 9, which is detachably attached to the main body of the electrophotographic apparatus using a guide device 10 such as a rail in the main body of the electrophotographic apparatus. Further, the electrophotographic apparatus may include the electrophotographic photosensitive member 1, the charging device 3, the exposing device, the developing device 5, and the transferring device 6.

Next, the DC voltage continuous application test is described with reference to FIGS. 5 and 6.

The DC voltage continuous application test is performed under an environment of normal temperature and normal humidity (23° C./50% RH).

Figure 5:
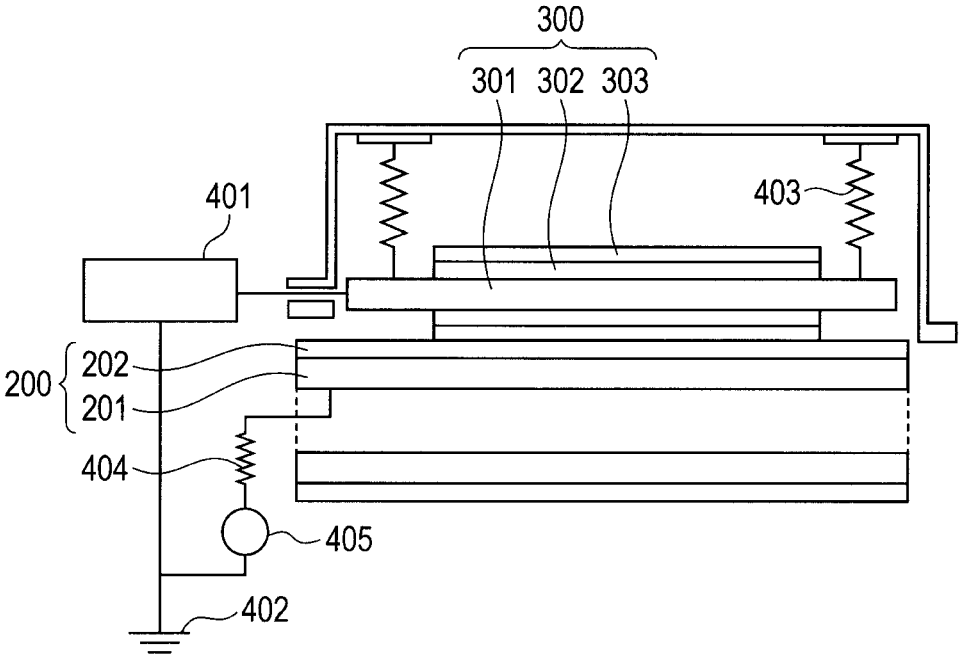
FIG. 5 is a view illustrating a test of continuously applying a voltage of −1.0 kV including only a DC component to a conductive layer.

FIG. 5 is a view illustrating the DC voltage continuous application test.

Figure 8:
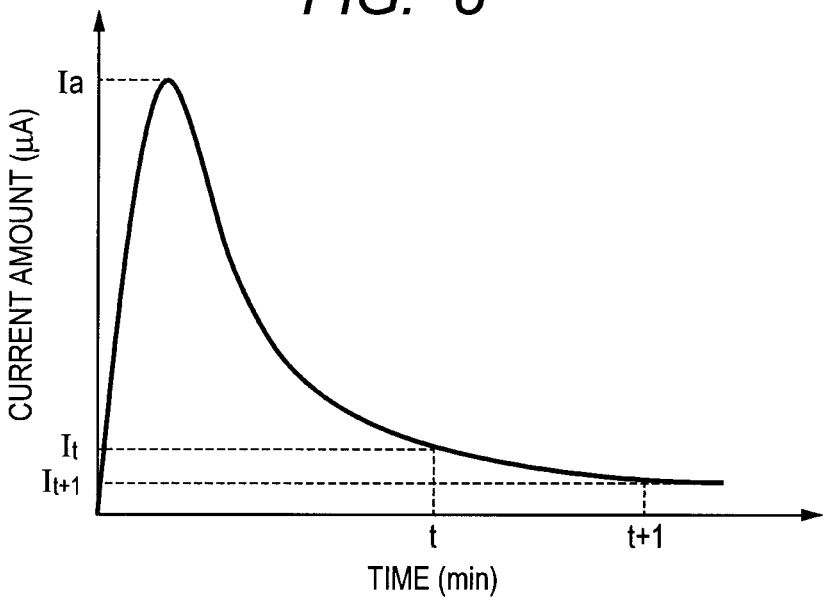
FIG. 8 is a view illustrating Ia [μA] and Ib [μA].

First, a sample (hereinafter, referred to as "test sample") 200 obtained by forming only the conductive layer 202 on the support 201 or by peeling each layer on the conductive layer 202 from the electrophotographic photosensitive member to leave only the conductive layer 202 on the support 201 is allowed to abut on a conductive roller 300 including a core metal 301, an elastic layer 302, and a surface layer 303 so that the axes of both the test sample and the conductive roller are parallel to each other. At this time, both ends of the core metal 301 of the conductive roller 300 are applied with a load of 500 g by springs 403. The core metal 301 of the conductive roller 300 is connected to a DC power source 401, and the support 201 of the test sample 200 is connected to a ground 402. A constant voltage of −1.0 kV including only a DC voltage (DC component) is applied continuously to the conductive roller 300 until a decrease ratio of a current amount per one minute flowing through the conductive layer reaches 1% or less for the first time. Thus, a voltage of −1.0 kV including only a DC voltage is continuously applied to the conductive layer 202. In FIG. 5, a resistor 404 (100 kΩ) and a current meter 405 are provided. In general, the absolute value of the current amount reaches the maximum current amount Ia immediately after the application of the voltage. After that, the absolute value of the current amount decreases, and the degree of the decrease becomes gentle gradually and finally reaches a saturated region (the decrease ratio of the current amount per one minute flowing through the conductive layer is 1% or less). Here, a predetermined time after the application of a voltage is defined as t [min], one minute after t [min] is defined as t+1 [min], the absolute value of the current amount at t [min] is defined as $I_t$ [μA], and the absolute value of the current amount at t+1 [min] is defined as $I_{t+1}$ [μA]. In this case, when $\{(I_t-I_{t-1})/I_t\}\times 100$ reaches 1 or less for the first time, t+1 corresponds to a time at which "the decrease ratio of the current amount per one minute flowing through the conductive layer reaches 1% or less for the first time." This is shown in FIG. 8.

Figure 6:
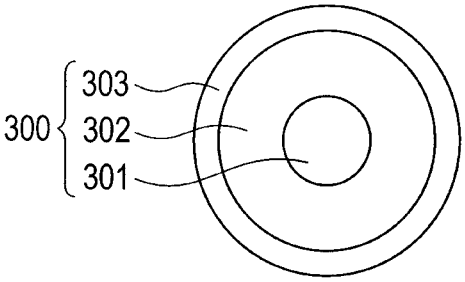
FIG. 6 is a view illustrating a schematic configuration of a conductive roller.

FIG. 6 illustrates a schematic configuration of the conductive roller 300 to be used in the test.

The conductive roller 300 includes the surface layer 303 having a medium resistance for controlling the resistance of the conductive roller 300, the conductive elastic layer 302 having elasticity required for forming a uniform nip with respect to the surface of the test sample 200, and the core metal 301.

In order to apply a voltage of −1.0 kV including only a DC component to the conductive layer 202 of the test sample 200 stably and continuously, it is necessary to keep the nip between the test sample 200 and the conductive roller 300 constant. In order to keep the nip constant, the hardness of the elastic layer 302 of the conductive roller 300 and the strength of the springs 403 have only to be adjusted appropriately. In addition, a mechanism for adjusting the nip may be provided.

The conductive roller 300 was produced as described below. The following "part(s)" refers to "part(s) by mass."

As the core metal 301, a stainless-steel core metal with a diameter of 6 mm was used.

Next, the conductive layer 302 was formed on the core metal 301 by the following method.

The following materials were kneaded for 10 minutes with a sealed mixer adjusted to 50° C. to prepare a raw material compound.

Epichlorohydrin rubber ternary copolymer (epichlorohydrin:ethylene oxide:allyl glycidyl ether=40 mol %:56 mol %:4 mol %); 100 parts Calcium carbonate (light calcium carbonate); 30 parts Aliphatic polyester (plasticizer); 5 parts Zinc stearate: 1 part 2-Mercaptobenzimidazole (antioxidant); 0.5 part Zinc oxide; 5 parts Quaternary ammonium salt represented by the following formula; 2 parts

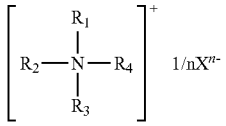

$R_1 = CH_3(CH_2)_6CH_2$
$R_2 = CH_3$
$R_3 = CH_3$
$R_4 = CH_2CH_2OH$
$X = ClO_4$
$n = 1$

Carbon black (surface-untreated product, average particle diameter: 0.2 μm, powder resistivity: 0.1 Ω·cm): 5 parts To this compound were added 1 part of sulfur as a vulcanizing agent, 1 part of dibenzothiazyl sulfide as a vulcanization accelerator, and 0.5 part of tetramethylthiuram monosulfide with respect to 100 parts of the epichlorohydrin rubber ternary copolymer as the rubber of the raw material, and the mixture was kneaded with a twin-roll mill cooled to 20° C. for 10 minutes.

The compound obtained by the kneading was molded on the core metal 301 by an extruder so as to have a roller shape with an outer diameter of 15 mm. The compound was vulcanized under heating steam and then polished so as to have an outer diameter of 10 mm, whereby an elastic roller with the elastic layer 302 formed on the core metal 301 was obtained. At this time, wide range polishing was adopted as the polishing process. The length of the elastic roller was set to 232 mm.

Next, the elastic layer 302 was covered with the surface layer 303 by the following method.

A mixed solution was prepared using the following materials in a glass bottle container.

Caprolactone modified acryl polyol solution; 100 parts

Methyl isobutyl ketone; 250 parts

Conductive tin oxide ($SnO_2$)

(trifluoropropyltrimethoxysilane-treated product, average particle diameter: 0.05 μm, powder resistivity: $1\times10^3$ Ω·cm); 250 parts Hydrophobic silica (dimethylpolysiloxane-treated product, average particle diameter: 0.02 μm, powder resistivity; $1\times10^{16}$ Ω·cm); 3 parts Modified dimethylsilicone oil; 0.08 part Cross-linked PMMA particle (average particle diameter: 4.98 μm); 80 parts The mixed solution was placed in a paint shaker dispersing machine, and glass beads each having an average particle diameter of 0.8 mm as a dispersion medium were filled so that the filling ratio was 80%. The resultant solution was dispersed for 18 hours to prepare a dispersion solution.

A 1:1 mixture of hexamethylene diisocyanate (HDI) and isophorone diisocyanate (IPDI) butanone oxime block products was added to the dispersion solution so as to achieve NCO/OH=1.0 to prepare a coating liquid for the surface layer.

The elastic layer 302 of the elastic roller was coated twice with the coating liquid for the surface layer by dip coating method, followed by drying with air and then drying at 160° C. for 1 hour to form the surface layer 303.

Thus, the conductive roller 300 including the core metal 301, the elastic layer 302, and the surface layer 303 was produced. The resistance of the conductive roller thus produced was measured as described below and found to be $1.0\times10^5\Omega$.

Figure 7:
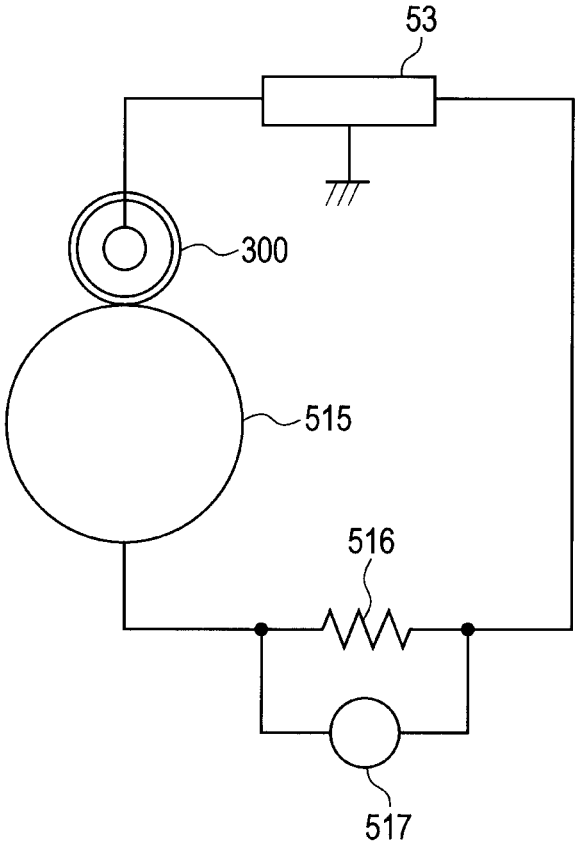
FIG. 7 is a view illustrating a method of measuring a resistance of a conductive roller.

FIG. 7 is a view illustrating a method of measuring a resistance of the conductive roller.

The resistance of the conductive roller is measured under an environment of normal temperature and normal humidity (23° C./50% RH). A cylindrical electrode 515 made of stainless steel is allowed to abut on the conductive roller 300 so that the axes of both the cylindrical electrode and the conductive roller are parallel to each other. At this time, both ends of the core metal (not shown) of the conductive roller are applied with a load of 500 g. As the cylindrical electrode 515, one having the same outer diameter as that of the test sample is selected to be used. Under the abutment, the cylindrical electrode 515 is driven to rotate at a rotation number of 200 rpm, and the conductive roller 300 is driven to rotate at the same velocity in accordance with the rotation of the cylindrical electrode, and a voltage of −200 V is applied to the cylindrical electrode 515 from an external power source 53. The resistance calculated from a value of current flowing through the conductive roller 300 at this time is defined as the resistance of the conductive roller 300. It should be noted that, in FIG. 7, a resistor 516 and a recorder 517 are provided.

EXAMPLES

Hereinafter, the present invention is described in more detail by way of specific examples. It should be noted that the present invention is not limited thereto. The "part(s)" in the examples refers to "part(s) by mass". All of the titanium oxide ($TiO_2$) particle (core particle) in various titanium oxide particle coated with tin oxide used in the examples and the comparative examples are spherical particle with a purity of 97.7% and a Bet value of 7.7 $m^2/g$ produced by a sulfuric acid method.

<Preparation Examples of Coating Liquid for the Conductive Layer>

(Preparation Example of Coating Liquid for the Conductive Layer 1)

In a sand mill using 450 parts of glass beads each having a diameter of 0.8 mm, 207 parts of titanium oxide ($TiO_2$) particle coated with tin oxide ($SnO_2$) doped with phosphorus (P) as the metal oxide particle (powder resistivity: $1.0\times10^3$ Ω·cm, average primary particle diameter: 220 nm), 144 parts of a phenol resin (phenol resin monomer/oligomer) (trade name: Priohphen J-325 manufactured by Dainippon Ink & Chemicals, Inc., resin solid content: 60% by mass) as a binder material, and 98 parts of 1-methoxy-2-propanol as a solvent were placed, and these materials were dispersed under the conditions of a rotation number of 2,000 rpm, a dispersion time of 3 hours, and a setting temperature of cooling water of 18° C. to obtain a dispersion solution.

The glass beads were removed from the dispersion solution with a mesh, and thereafter, 13.8 parts of silicone resin particles (trade name: Tospal 120 manufactured by Momentive Performance Materials Inc., average particle diameter: 2 μm) as a surface-roughness imparting agent, 0.014 part of silicone oil (trade name: SH28PA manufactured by Dow Corning Toray Co., Ltd.) as a leveling agent, 6 parts of methanol, and 6 parts of 1-methoxy-2-propanol were added to the dispersion solution, followed by stirring, to prepare a coating liquid for the conductive layer.

The average particle diameter of the metal oxide particles (titanium oxide ($TiO_2$) particle coated with tin oxide ($SnO_2$) doped with phosphorus (P)) in the coating liquid for the conductive layer 1 was 0.28 μm.

(Preparation Examples of Coating Liquids for the Conductive Layer 2 to 17 and C1 to C24)

Coating liquids for the conductive layer 2 to 17 and C1 to C24 were prepared by the same procedure as that of the preparation example of the coating liquid for the conductive layer 1, except that the kinds, powder resistivities, and amounts (parts) of the metal oxide particle used for preparing the coating liquids for the conductive layer, the amount (parts) of the phenol resin (phenol resin monomer/oligomer) as the binder material, and the dispersion time were set respectively as shown in Tables 1 and 2. Tables 1 and 2 respectively show the average particle diameters of the metal oxide particles in the coating liquids for the conductive layer 2 to 17 and C1 to C24. Tin oxide is "$SnO_2$" and titanium oxide is "$TiO_2$" in Tables 1 and 2.

TABLE 1

| Coating liquid for the conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion time [h] | In coating liquid for the conductive layer P/B | Average particle diameter of metal oxide particles [μm] |
|---|---|---|---|---|---|---|---|
| 1 | Titanium oxide | $1.0 \times 10^3$ | 207 | 144 | 3 | 2.4/1.0 | 0.28 |
| 2 | particle coated | $3.0 \times 10^3$ | 207 | 144 | 3 | 2.4/1.0 | 0.28 |
| 3 | with tin oxide | $1.0 \times 10^4$ | 207 | 144 | 3 | 2.4/1.0 | 0.28 |
| 4 | doped with phosphorus | $5.0 \times 10^4$ | 207 | 144 | 3 | 2.4/1.0 | 0.28 |
| 5 | (Average primary | $1.0 \times 10^5$ | 207 | 144 | 3 | 2.4/1.0 | 0.28 |
| 6 | particle diameter: | $1.0 \times 10^3$ | 228 | 109 | 3 | 3.5/1.0 | 0.30 |
| 7 | 220 nm) | $3.0 \times 10^3$ | 228 | 109 | 3 | 3.5/1.0 | 0.30 |
| 8 | | $5.0 \times 10^4$ | 228 | 109 | 3 | 3.5/1.0 | 0.30 |
| 9 | | $1.0 \times 10^5$ | 228 | 109 | 3 | 3.5/1.0 | 0.30 |
| 10 | | $1.0 \times 10^3$ | 176 | 195 | 3 | 1.5/1.0 | 0.26 |
| 11 | | $3.0 \times 10^3$ | 176 | 195 | 3 | 1.5/1.0 | 0.26 |
| 12 | | $5.0 \times 10^4$ | 176 | 195 | 3 | 1.5/1.0 | 0.26 |
| 13 | | $1.0 \times 10^5$ | 176 | 195 | 3 | 1.5/1.0 | 0.26 |
| 14 | | $5.0 \times 10^3$ | 207 | 144 | 1.5 | 2.4/1.0 | 0.32 |
| 15 | | $5.0 \times 10^3$ | 207 | 144 | 4.5 | 2.4/1.0 | 0.26 |
| 16 | | $1.0 \times 10^3$ | 228 | 109 | 2 | 3.5/1.0 | 0.34 |
| 17 | | $1.0 \times 10^5$ | 176 | 195 | 4 | 1.5/1.0 | 0.25 |

TABLE 2

| Coating liquid for the conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion time [h] | In coating liquid for the conductive layer P/B | Average particle diameter of metaloxide particles [μm] |
|---|---|---|---|---|---|---|---|
| C1 | Titanium oxide | $5.0 \times 10^2$ | 207 | 144 | 3 | 2.4/1.0 | 0.28 |
| C2 | particle coated | $5.0 \times 10^5$ | 207 | 144 | 3 | 2.4/1.0 | 0.28 |
| C3 | with tin oxide | $5.0 \times 10^2$ | 228 | 109 | 3 | 3.5/1.0 | 0.34 |
| C4 | doped with phosphorus | $5.0 \times 10^2$ | 176 | 195 | 3 | 1.5/1.0 | 0.26 |
| C5 | (average primary | $5.0 \times 10^5$ | 228 | 109 | 3 | 3.5/1.0 | 0.34 |
| C6 | particle diameter: | $5.0 \times 10^5$ | 176 | 195 | 3 | 1.5/1.0 | 0.26 |
| C7 | 220 nm) | $1.0 \times 10^3$ | 171 | 203 | 3 | 1.4/1.0 | 0.26 |
| C8 | | $1.0 \times 10^3$ | 285 | 132 | 3 | 3.6/1.0 | 0.35 |
| C9 | | $1.0 \times 10^5$ | 171 | 203 | 3 | 1.4/1.0 | 0.24 |
| C10 | | $1.0 \times 10^5$ | 285 | 132 | 3 | 3.6/1.0 | 0.35 |
| C11 | | $1.0 \times 10^3$ | 228 | 109 | 1 | 3.5/1.0 | 0.40 |
| C12 | | $1.0 \times 10^5$ | 176 | 195 | 6 | 1.5/1.0 | 0.24 |
| C13 | Titanium oxide particle coated with tin oxide doped with antimony (average primary particle diameter: 220 nm) | $1.0 \times 10^3$ | 176 | 195 | 3 | 1.5/1.0 | 0.25 |
| C14 | Titanium oxide particle coated with oxygen-deficient tin oxide (average primary particle diameter: 220 nm) | $1.0 \times 10^3$ | 176 | 195 | 3 | 1.5/1.0 | 0.27 |
| C15 | Titanium oxide particle coated with untreated tin oxide (average primary | $1.0 \times 10^5$ | 228 | 109 | 3 | 3.5/1.0 | 0.36 |

TABLE 2-continued

| Coating liquid for the conductive layer | Metal oxide particle (P) Kind | Powder resistivity [Ω · cm] | Amount [parts] | Binder material (B) (phenol resin) Amount [parts] (resin solid content is 60% by mass of amount below) | Dispersion time [h] | In coating liquid for the conductive layer P/B | Average particle diameter of metaloxide particles [μm] |
|---|---|---|---|---|---|---|---|
| | particle diameter: 220 nm) | | | | | | |
| C16 | Uncoated titanium oxide particle (average primary particle diameter: 210 nm) | $1.0 \times 10^5$ | 228 | 109 | 3 | 3.5/1.0 | 0.37 |
| C17 | Tin oxide particle | $1.0 \times 10^3$ | 228 | 109 | 3 | 3.5/1.0 | 0.47 |
| C18 | doped with phosphorus | $1.0 \times 10^5$ | 228 | 109 | 3 | 3.5/1.0 | 0.47 |
| C19 | (average primary | $1.0 \times 10^3$ | 176 | 195 | 3 | 1.5/1.0 | 0.49 |
| C20 | particle diameter: 150 nm) | $1.0 \times 10^5$ | 176 | 195 | 3 | 1.5/1.0 | 0.49 |
| C21 | Barium sulfate | $1.0 \times 10^3$ | 228 | 109 | 3 | 3.5/1.0 | 0.26 |
| C22 | particle coated | 1.0 × 105 | 228 | 109 | 3 | 3.5/1.0 | 0.26 |
| C23 | with tin oxide | $1.0 \times 10^3$ | 176 | 195 | 3 | 1.5/1.0 | 0.27 |
| C24 | doped with phosphorus (average primary particle diameter: 200 nm) | $1.0 \times 10^5$ | 176 | 195 | 3 | 1.5/1.0 | 0.27 |

<Production Examples of Electrophotographic Photosensitive Member>

(Production Example of Electrophotographic Photosensitive Member 1)

An aluminum cylinder (JIS-A3003, aluminum alloy) with a length of 246 mm and a diameter of 24 mm, which was produced by a production method including an extrusion and a drawing, was used as a support.

The support was dip-coated with the coating liquid for the conductive layer 1 under an environment of normal temperature and normal humidity (23° C./50% RH), and the resultant was dried and heat-cured at 140° C. for 30 minutes to form a conductive layer with a thickness of 30 μm. The volume resistivity of the conductive layer was measured by the above-mentioned method and found to be $5.0 \times 10^9$ Ω·cm. Further, the maximum current amount Ia and the current amount Ib of the conductive layer were measured by the above-mentioned method. As a result, the maximum current amount Ia and the current amount Ib were found to be 5,400 μA and 34 μA, respectively.

Next, 4.5 parts of N-methoxymethylated nylon (trade name: Toresin EF-30T manufactured by Nagase ChemteX Corporation) and 1.5 parts of a copolymerized nylon resin (trade name: Amilan CM8000 manufactured by Toray Co., Ltd.) were dissolved in a mixed solvent of 65 parts of methanol and 30 parts of n-butanol to prepare a coating liquid for the undercoat layer. The conductive layer was dip-coated with the coating liquid for the undercoat layer, followed by drying at 70° C. for 6 minutes, to form an undercoat layer with a thickness of 0.85 μm.

Subsequently, 10 parts of crystalline hydroxygallium phthalocyanine crystal (charge generating material) having strong peaks at Bragg angles (2θ±0.2°) of 7.5°, 9.9°, 16.3°, 18.6°, 25.1°, and 28.3° in CuKα-characteristic X-ray diffraction, 5 parts of polyvinyl butyral (trade name: S-LEX BX-1 manufactured by Sekisui Chemical, Co., Ltd.), and 250 parts of cyclohexanone were placed in a sand mill with glass beads each having a diameter of 0.8 mm and dispersed under the condition of a dispersion time of 3 hours. Then, 250 parts of ethyl acetate were added to the mixture to prepare a coating liquid for the charge generation layer. The undercoat layer was dip-coated with the coating liquid for the charge generation layer, followed by drying at 100° C. for 10 minutes, to form a charge generation layer with a thickness of 0.12 μm.

Next, 4.8 parts of an amine compound (charge transporting material) represented by the following formula (CT-1) and 3.2 parts of an amine compound (charge transporting material) represented by the following formula (CT-2):

(CT-1)

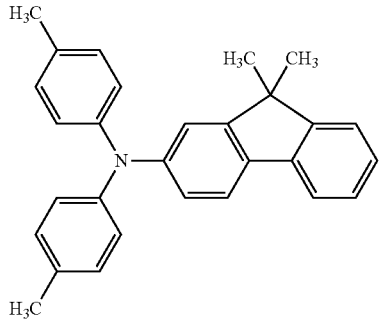

(CT-2)

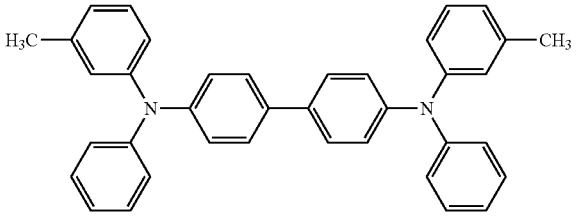

and 10 parts of polycarbonate (trade name: 2200 manufactured by Mitsubishi Engineering-Plastics Corporation) were dissolved in a mixed solvent of 30 parts of dimethoxymethane and 70 parts of chlorobenzene to prepare a coating liquid for the charge transport layer. The charge generation layer was dip-coated with the coating liquid for the charge transport layer, followed by drying at 110° C. for 30 minutes, to form a charge transport layer with a thickness of 7.5 μm.

Thus, the electrophotographic photosensitive member 1 including the charge transport layer as a surface layer was produced.

(Production Examples of Electrophotographic Photosensitive Members 2 to 17 and C1 to C24)

Electrophotographic photosensitive members 2 to 17 and C1 to C24 each including a charge transport layer as a surface layer were produced by the same procedure as that of the production example of the electrophotographic photosensitive member 1, except that the coating liquid for the conductive layer 1, which was the coating liquid for the conductive layer used in the production of the electrophotographic photosensitive member, was changed to coating liquids for the conductive layer 2 to 17 and C1 to C24, respectively. It should be noted that the volume resistivity, and the maximum current amount Ia and the current amount Ib of the conductive layers of the electrophotographic photosensitive members 2 to 17 and C1 to C24 were measured by the above-mentioned method in the same way as in the conductive layer of the electrophotographic photosensitive member 1. Tables 3 and 4 show the results. It should be noted that the surfaces of the conductive layers were observed with an optical microscope in the measurement of the volume resistivities of the conductive layers in the electrophotographic photosensitive members 1 to 17 and C1 to C24, and as a result, the occurrence of a crack was observed in each of the conductive layers of the electrophotographic photosensitive members C8 and C10.

TABLE 3

| Electro-photographic photo-sensitive member | Coating liquid for the conductive layer | Volume resistivity of conductive layer [Ω · cm] | Crack in conductive layer | Maximum current amount Ia [μA] | Current amount Ib [μA] |
|---|---|---|---|---|---|
| 1 | 1 | $5.0 \times 10^{9}$ | Absent | 5,400 | 34 |
| 2 | 2 | $1.0 \times 10^{10}$ | Absent | 4,000 | 24 |
| 3 | 3 | $5.0 \times 10^{10}$ | Absent | 3,600 | 22 |
| 4 | 4 | $1.0 \times 10^{11}$ | Absent | 3,200 | 20 |
| 5 | 5 | $5.0 \times 10^{11}$ | Absent | 2,800 | 16 |
| 6 | 6 | $1.0 \times 10^{9}$ | Absent | 5,800 | 36 |
| 7 | 7 | $5.0 \times 10^{9}$ | Absent | 4,400 | 28 |
| 8 | 8 | $5.0 \times 10^{10}$ | Absent | 3,600 | 22 |
| 9 | 9 | $1.0 \times 10^{11}$ | Absent | 3,200 | 18 |
| 10 | 10 | $1.0 \times 10^{10}$ | Absent | 5,100 | 32 |
| 11 | 11 | $5.0 \times 10^{10}$ | Absent | 3,600 | 22 |
| 12 | 12 | $5.0 \times 10^{11}$ | Absent | 2,800 | 20 |
| 13 | 13 | $1.0 \times 10^{12}$ | Absent | 2,400 | 12 |
| 14 | 14 | $1.0 \times 10^{9}$ | Absent | 4,800 | 30 |
| 15 | 15 | $1.0 \times 10^{11}$ | Absent | 3,200 | 20 |
| 16 | 16 | $1.0 \times 10^{8}$ | Absent | 6,000 | 40 |
| 17 | 17 | $5.0 \times 10^{12}$ | Absent | 2,000 | 10 |

TABLE 4

| Electro-photographic photo-sensitive member | Coating liquid for the conductive layer | Volume resistivity of conductive layer [Ω · cm] | Crack in conductive layer | Maximum current amount Ia [μA] | Current amount Ib [μA] |
|---|---|---|---|---|---|
| C1 | C1 | $1.0 \times 10^{9}$ | Absent | 6,800 | 42 |
| C2 | C2 | $1.0 \times 10^{12}$ | Absent | 2,400 | 6 |
| C3 | C3 | $5.0 \times 10^{8}$ | Absent | 7,400 | 44 |
| C4 | C4 | $5.0 \times 10^{9}$ | Absent | 6,400 | 42 |
| C5 | C5 | $5.0 \times 10^{11}$ | Absent | 2,800 | 7 |
| C6 | C6 | $5.0 \times 10^{12}$ | Absent | 2,000 | 5 |
| C7 | C7 | $5.0 \times 10^{9}$ | Absent | 6,400 | 42 |
| C8 | C8 | $5.0 \times 10^{8}$ | Present | 7,400 | 44 |
| C9 | C9 | $5.0 \times 10^{12}$ | Absent | 2,000 | 5 |
| C10 | C10 | $5.0 \times 10^{10}$ | Present | 3,600 | 9 |
| C11 | C11 | $5.0 \times 10^{7}$ | Absent | 6,100 | 40 |

TABLE 4-continued

| Electro-photographic photo-sensitive member | Coating liquid for the conductive layer | Volume resistivity of conductive layer [Ω · cm] | Crack in conductive layer | Maximum current amount Ia [μA] | Current amount Ib [μA] |
|---|---|---|---|---|---|
| C12 | C12 | $1.0 \times 10^{13}$ | Absent | 1,800 | 5 |
| C13 | C13 | $1.0 \times 10^{10}$ | Absent | 10,000 | 50 |
| C14 | C14 | $1.0 \times 10^{10}$ | Absent | 7,000 | 46 |
| C15 | C15 | $1.0 \times 10^{11}$ | Absent | 3,200 | 2 |
| C16 | C16 | $1.0 \times 10^{11}$ | Absent | 3,200 | 2 |
| C17 | C17 | $1.0 \times 10^{9}$ | Absent | 7,300 | 48 |
| C18 | C18 | $1.0 \times 10^{11}$ | Absent | 4,200 | 8 |
| C19 | C19 | $1.0 \times 10^{10}$ | Absent | 6,500 | 46 |
| C20 | C20 | $1.0 \times 10^{12}$ | Absent | 3,400 | 7 |
| C21 | C21 | $1.0 \times 10^{9}$ | Absent | 7,800 | 48 |
| C22 | C22 | $1.0 \times 10^{11}$ | Absent | 4,700 | 9 |
| C23 | C23 | $1.0 \times 10^{10}$ | Absent | 7,000 | 46 |
| C24 | C24 | $1.0 \times 10^{12}$ | Absent | 3,900 | 8 |

Examples 1 to 17 and Comparative Examples 1 to 24

The electrophotographic photosensitive members 1 to 17 and C1 to C24 were each mounted onto a laser beam printer (trade name: HP Laserjet P1505) manufactured by Hewlett-Packard Development Company, L.P., and a sheet feeding durability test was performed under an environment of low temperature and low humidity (15° C./10% RH), whereby images were evaluated. In the sheet feeding durability test, a text image having a coverage rate of 2% was printed on a letter size sheet one by one in an intermittent mode, and 3,000 sheets of images were output.

Then, at the start of the sheet feeding durability test, and after the end of the output of 1,500 sheets of images and the end of the output of 3,000 sheets of images, each one sample for image evaluation (half-tone image of one dot KEIMA pattern) was output.

The images were evaluated based on the following criteria. Tables 5 and 6 show the results.

A: No leakage is observed.

B: Leakage is observed slightly as small black spots.

C: Leakage is observed clearly as large black spots.

D: Leakage is observed as large black spots and short lateral black streaks.

E: Leakage is observed as long lateral black streaks.

Further, at the start of the sheet feeding durability test and after the output of the sample for image evaluation after the end of the output of 3,000 sheets of images, a charge potential (dark area potential) and a potential at the time of exposure (light area potential) were measured. The potentials were measured using one sheet of a white solid image and one sheet of a black solid image. An initial dark area potential (at the time of the start of the sheet feeding durability test) was defined as Vd, and an initial light area potential (at the time of the start of the sheet feeding durability test) was defined as Vl. A dark area potential after the end of the output of 3,000 sheets of images was defined as Vd', and a light area potential after the end of the output of 3,000 sheets of images was defied as Vl'. A dark area potential variation level ΔVd (=|Vd'|−|Vd|), a difference between the dark area potential Vd' after the end of the output of 3,000 sheets of images and the initial dark area potential Vd, and a light area potential variation level ΔVl (=|Vl'|−|Vl|), a difference between the light area potential Vl' after the end of the output of 3,000 sheets of images and the initial light area potential Vl, were respectively determined. Tables 5 and 6 show the results.

TABLE 5

| Example | Electrophotographic photosensitive member | Leakage: At start of sheet feeding durability test | Leakage: After end of output of 1,500 sheets of images | Leakage: After end of output of 3,000 sheets of images | Potential variation level [V] ΔVd | Potential variation level [V] ΔVl |
|---|---|---|---|---|---|---|
| 1 | 1 | A | A | B | +10 | +20 |
| 2 | 2 | A | A | A | +10 | +25 |
| 3 | 3 | A | A | A | +11 | +25 |
| 4 | 4 | A | A | A | +10 | +25 |
| 5 | 5 | A | A | A | +12 | +32 |
| 6 | 6 | A | A | B | +10 | +20 |
| 7 | 7 | A | A | A | +11 | +22 |
| 8 | 8 | A | A | A | +10 | +25 |
| 9 | 9 | A | A | A | +10 | +31 |
| 10 | 10 | A | A | B | +10 | +20 |
| 11 | 11 | A | A | A | +10 | +25 |
| 12 | 12 | A | A | A | +10 | +26 |
| 13 | 13 | A | A | A | +11 | +33 |
| 14 | 14 | A | A | A | +10 | +21 |
| 15 | 15 | A | A | A | +11 | +25 |
| 16 | 16 | A | B | B | +10 | +20 |
| 17 | 17 | A | A | A | +10 | +35 |

TABLE 6

| Comparative Example | Electrophotographic photosensitive member | Leakage: At start of sheet feeding durability test | Leakage: After end of output of 1,500 sheets of images | Leakage: After end of output of 3,000 sheets of images | Potential variation level [V] ΔVd | Potential variation level [V] ΔVl |
|---|---|---|---|---|---|---|
| 1 | C1 | C | C | C | +10 | +24 |
| 2 | C2 | A | A | A | +12 | +55 |
| 3 | C3 | C | C | D | +10 | +24 |
| 4 | C4 | B | C | C | +11 | +24 |
| 5 | C5 | A | A | A | +12 | +50 |
| 6 | C6 | A | A | A | +13 | +60 |
| 7 | C7 | B | C | C | +10 | +24 |
| 8 | C8 | C | C | D | +10 | +24 |
| 9 | C9 | A | A | A | +12 | +60 |
| 10 | C10 | B | B | B | +11 | +45 |
| 11 | C11 | B | B | C | +10 | +25 |
| 12 | C12 | A | A | A | +12 | +65 |
| 13 | C13 | E | E | E | +10 | +20 |
| 14 | C14 | B | C | C | +10 | +24 |
| 15 | C15 | A | A | A | +12 | +70 |
| 16 | C16 | A | A | A | +11 | +70 |
| 17 | C17 | D | D | D | +10 | +23 |
| 18 | C18 | B | C | C | +10 | +40 |
| 19 | C19 | C | D | D | +10 | +23 |
| 20 | C20 | B | B | B | +11 | +45 |
| 21 | C21 | D | E | E | +10 | +22 |
| 22 | C22 | B | C | C | +10 | +41 |
| 23 | C23 | D | D | E | +11 | +22 |
| 24 | C24 | B | B | B | +12 | +47 |

Examples 18 to 34 and Comparative Examples 25 to 48

Separately from a set of the electrophotographic photosensitive members 1 to 17 and C1 to C24 each subjected to the sheet feeding durability test, another set of the electrophotographic photosensitive members 1 to 17 and C1 to C24 was prepared, and a needle-withstanding test was performed as described below. Table 7 shows the results.

Figure 4:
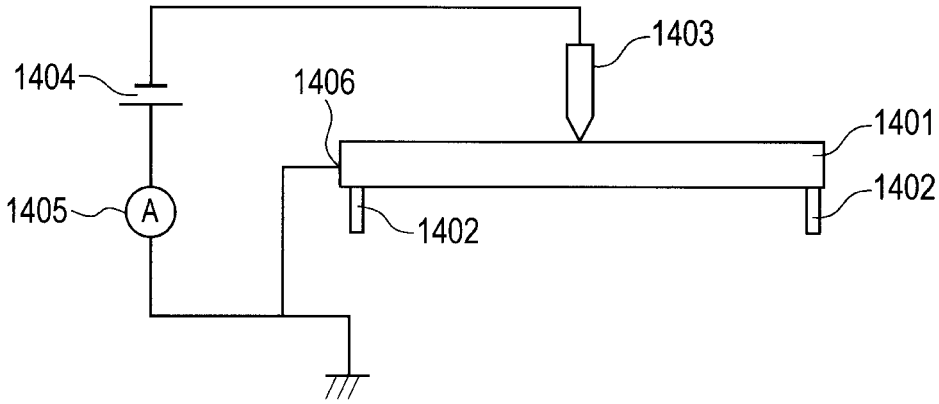
FIG. 4 is a view illustrating an example of a needle-withstanding test apparatus.

FIG. 4 illustrates a needle-withstanding test apparatus. The needle-withstanding test is performed under an environment of normal temperature and normal humidity (23° C./50% RH). Both ends of an electrophotographic photosensitive member 1401 are fixed so as not to move on a fixing board 1402. A tip of a needle electrode 1403 is brought into contact with the surface the electrophotographic photosensitive member 1401. A power source 1404 for applying a voltage and a current meter 1405 for measuring a current are each connected to the needle electrode 1403. A portion 1406, which comes into contact with a support of the electrophotographic photosensitive member 1401, is connected to a ground. A voltage to be applied from the needle electrode 1403 for 2 seconds is raised by 10 V from 0 V, and leakage occurs inside the electrophotographic photosensitive member 1401 in contact with which the tip of the needle electrode 1403, and the value of the current meter 1405 starts to increase 10 times or more. A voltage at that time is defined as a needle-withstanding value. The measurement is performed at five sites in the surface of the electrophotographic photosensitive member 1401, and an average value thereof is defined as the needle-withstanding value of the measured electrophotographic photosensitive member 1401.

TABLE 7

| Example | Electrophotographic photosensitive member | Needle-withstanding value [−V] | Comparative Example | Electrophotographic photosensitive member | Needle-withstanding value [−V] |
|---|---|---|---|---|---|
| 18 | 1 | 4,100 | 25 | C1 | 3,200 |
| 19 | 2 | 4,750 | 26 | C2 | 4,950 |
| 20 | 3 | 4,800 | 27 | C3 | 3,100 |
| 21 | 4 | 4,850 | 28 | C4 | 3,300 |
| 22 | 5 | 4,900 | 29 | C5 | 4,900 |
| 23 | 6 | 4,050 | 30 | C6 | 5,000 |
| 24 | 7 | 4,700 | 31 | C7 | 3,300 |
| 25 | 8 | 4,800 | 32 | C8 | 2,100 |
| 26 | 9 | 4,850 | 33 | C9 | 5,000 |
| 27 | 10 | 4,200 | 34 | C10 | 3,800 |
| 28 | 11 | 4,800 | 35 | C11 | 3,500 |
| 29 | 12 | 4,900 | 36 | C12 | 5,000 |
| 30 | 13 | 4,950 | 37 | C13 | 2,000 |
| 31 | 14 | 4,600 | 38 | C14 | 3,100 |
| 32 | 15 | 4,850 | 39 | C15 | 4,850 |
| 33 | 16 | 4,000 | 40 | C16 | 4,850 |
| 34 | 17 | 5,000 | 41 | C17 | 2,900 |
| | | | 42 | C18 | 4,730 |
| | | | 43 | C19 | 3,000 |
| | | | 44 | C20 | 4,830 |
| | | | 45 | C21 | 2,500 |
| | | | 46 | C22 | 4,630 |
| | | | 47 | C23 | 2,700 |
| | | | 48 | C24 | 4,740 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-046516, filed Mar. 3, 2011, No. 2011-215134, filed Sep. 29, 2011, and No. 2012-039023, filed Feb. 24, 2012 which are hereby incorporated by reference herein in their entirety.

The invention claimed is:

1. An electrophotographic photosensitive member, comprising:

a cylindrical support;

a conductive layer comprising a binder material and a metal oxide particle formed on the cylindrical support; and a photosensitive layer formed on the conductive layer, wherein the metal oxide particle is a titanium oxide particle coated with tin oxide doped with phosphorus;

when an absolute value of a maximum current amount flowing through the conductive layer in a case of performing a test of continuously applying a voltage of −1.0 kV comprising only a DC voltage to the conductive layer is defined as Ia [μA], and an absolute value of a current amount flowing through the conductive layer in a case where a decrease ratio of a current amount per one minute flowing through the conductive layer reaches 1% or less for the first time is defined as Ib [μA], the Ia and the Ib satisfy the following relations (i) and (ii); and $$Ia \leq 6000 \quad \text{(i); and}$$

$$10 \leq Ib \quad \text{(ii),}$$

a volume resistivity of the conductive layer before the test is performed is from $1.0\times10^{8}$ to $5.0\times10^{12}$ Ω·cm.

2. The electrophotographic photosensitive member according to claim 1, wherein the Ia and the Ib satisfy the following relations (iii) and (iv):

$$Ia \leq 5000 \quad \text{(iii); and}$$

$$20 \leq Ib \quad \text{(iv).}$$

3. A process cartridge detachably attachable to a main body of an electrophotographic apparatus, wherein the process cartridge integrally supports:

the electrophotographic photosensitive member according to claim 1; and at least one device selected from the group consisting of a charging device, a developing device, a transferring device, and a cleaning device.

4. An electrophotographic apparatus, comprising:

the electrophotographic photosensitive member according to claim 1, a charging device, an exposing device, a developing device, and a transferring device.

5. A method of manufacturing an electrophotographic photosensitive member, the method comprising:

the step of forming a conductive layer with a volume resistivity of $1.0\times10^{8}$ Ω·cm or more to $5.0\times10^{12}$ Ω·cm or less on a cylindrical support; and the step of forming a photosensitive layer on the conductive layer, wherein, the step of forming the conductive layer comprises:

preparing a coating liquid for the conductive layer by use of:

a solvent, a binder material, and a metal oxide particle with a powder resistivity of $1.0\times10^{3}$ to $1.0\times10^{5}$ Ω·cm, and forming the conductive layer by use of the coating liquid for the conductive layer;

a mass ratio (P/B) of the metal oxide particle (P) to the binder material (B) in the coating liquid for the conductive layer, is from 1.5/1.0 to 3.5/1.0; and the metal oxide particle is a titanium oxide particle coated with tin oxide doped with phosphorus.

6. The method of manufacturing an electrophotographic photosensitive member according to claim 5, wherein the powder resistivity of the metal oxide particle is from $3.0\times10^{3}$ to $5.0\times10^{4}$ Ω·cm.

* * * * *